US010446001B2

(12) United States Patent
Strassburger

(10) Patent No.: US 10,446,001 B2
(45) Date of Patent: Oct. 15, 2019

(54) WALLET SECURITY DISPLAY HANGER

(71) Applicant: B&G Plastics, Inc., Union, NJ (US)

(72) Inventor: Jacob Strassburger, South Plainfield, NJ (US)

(73) Assignee: B&G Plastics, Inc., Union, NJ (US)

( * ) Notice: Subject to any disclaimer, the term of this patent is extended or adjusted under 35 U.S.C. 154(b) by 0 days.

(21) Appl. No.: 16/015,940

(22) Filed: Jun. 22, 2018

(65) Prior Publication Data

US 2019/0027008 A1 Jan. 24, 2019

Related U.S. Application Data

(60) Provisional application No. 62/534,251, filed on Jul. 19, 2017.

(51) Int. Cl.

| | |
|---|---|
| ***G08B 13/12*** | (2006.01) |
| ***G08B 13/14*** | (2006.01) |
| ***G08B 13/24*** | (2006.01) |
| ***E05B 73/00*** | (2006.01) |
| ***E05B 69/00*** | (2006.01) |

(52) U.S. Cl.

CPC ..... *G08B 13/2417* (2013.01); *E05B 69/006* (2013.01); *E05B 73/0017* (2013.01); *G08B 13/24* (2013.01)

(58) Field of Classification Search

CPC ..... G08B 13/2417; E05B 69/006; E05B 73/0017

USPC ..... 340/568.7

See application file for complete search history.

(56) References Cited

U.S. PATENT DOCUMENTS

| | | | |
|---|---|---|---|
| 4,714,156 | A | 12/1987 | Kolton et al. |
| 4,765,467 | A | 8/1988 | Kolton et al. |
| 4,768,649 | A | 9/1988 | Kolton et al. |
| 4,930,692 | A | 6/1990 | Smilow et al. |
| 5,110,019 | A | 5/1992 | Kolton et al. |
| 5,123,577 | A | 6/1992 | Kolton et al. |
| 5,222,638 | A | 6/1993 | Kolton et al. |
| 5,328,065 | A | 7/1994 | Kolton et al. |
| 5,501,378 | A | 3/1996 | Kolton et al. |
| 5,582,387 | A | 12/1996 | Kolton et al. |
| 5,615,810 | A | 4/1997 | Kolton et al. |
| 5,826,760 | A | 10/1998 | Kolton et al. |
| 5,988,462 | A | 11/1999 | Kolton |
| 6,073,758 | A | 6/2000 | Webster et al. |
| 6,206,253 | B1 | 3/2001 | Kolton et al. |
| 6,264,077 | B1 | 7/2001 | Kolton et al. |

(Continued)

*Primary Examiner* — Tanmay K Shah

(74) *Attorney, Agent, or Firm* — Hoffman & Baron, LLP

(57) ABSTRACT

A wallet security display hanger includes a display hanger hook and a body member integrally connected to the logo display member. The body member includes an upper support member having an upper flap, a lower support member integrally connected to the upper support member via a connecting section, such that a first slot is formed between the upper and lower support members, and a main flap integrally connected to the lower support member via a main foldline section, such that a second slot is formed between the lower support member and the main flap. The upper and main flaps are configured to be folded onto the lower support member to close the first and second slots for locking engagement, respectively, to prevent the wallet from being removed from the wallet security display hanger.

20 Claims, 7 Drawing Sheets

(56) References Cited

U.S. PATENT DOCUMENTS

| | | | | |
|---|---|---|---|---|
| 6,325,219 | B1 * | 12/2001 | Schild | A47F 7/024 211/4 |
| 6,561,358 | B2 | 5/2003 | Kolton et al. | |
| 7,143,892 | B2 | 12/2006 | Kolton et al. | |
| 7,448,520 | B2 | 11/2008 | Kolton et al. | |
| 8,286,882 | B2 | 10/2012 | Norman et al. | |
| 8,308,291 | B2 | 11/2012 | Norman et al. | |
| 8,651,344 | B2 | 2/2014 | Norman et al. | |
| 9,480,347 | B2 | 11/2016 | Strassburger et al. | |
| 9,585,496 | B2 | 3/2017 | Strassburger et al. | |
| 2013/0027201 | A1 * | 1/2013 | Schuller | G08B 13/1472 340/539.13 |
| 2016/0058209 | A1 | 3/2016 | Strassburger et al. | |
| 2017/0253408 | A1 | 9/2017 | Strassburger | |
| 2018/0087293 | A1 | 3/2018 | Strassburger et al. | |

* cited by examiner

WALLET SECURITY DISPLAY HANGER

CROSS REFERENCE TO RELATED APPLICATION

This application claims priority to U.S. Provisional Patent Application No. 62/534,251, filed on Jul. 19, 2017, the contents of which are incorporated herein by reference in its entirety.

FIELD OF THE INVENTION

The present invention relates to wallet display hangers, and more particularly, to wallet security display hangers with a theft deterrent locking mechanism.

BACKGROUND OF THE INVENTION

Wallets are commonly displayed for sale in retail stores on racks or hung on a display hook, such as a pegboard hook. It is customary for customers to examine the wallets before purchasing. However, handling of the wallet can lead to security concerns, and the customers can easily remove the wallet from the premises. Thus, retailers have implemented a variety of different hangers with electronic security tags to secure the wallets. The security tags can be enclosed in or attached to a variety of different devices, such as a holder or a housing, which are used to attach the security tags to the wallet. However, this presents both manufacturing and assembling issues, such as cost increase and product complexity.

SUMMARY OF THE INVENTION

According to an embodiment of the present invention, a wallet security display hanger includes a display hanger hook and a body member integrally connected to the logo display member. The body member includes an upper support member having an upper flap, a lower support member integrally connected to the upper support member via a connecting section, such that a first slot is formed between the upper and lower support members, and a main flap integrally connected to the lower support member via a main foldline section, such that a second slot is formed between the lower support member and the main flap. The upper and main flaps are configured to be folded onto the lower support member to close the first and second slots for locking engagement, respectively, to prevent the wallet from being removed from the wallet security display hanger.

These and other aspects of the present invention will be better understood in view of the drawings and following detailed description.

DETAILED DESCRIPTION OF PREFERRED EMBODIMENTS

Figure 1:
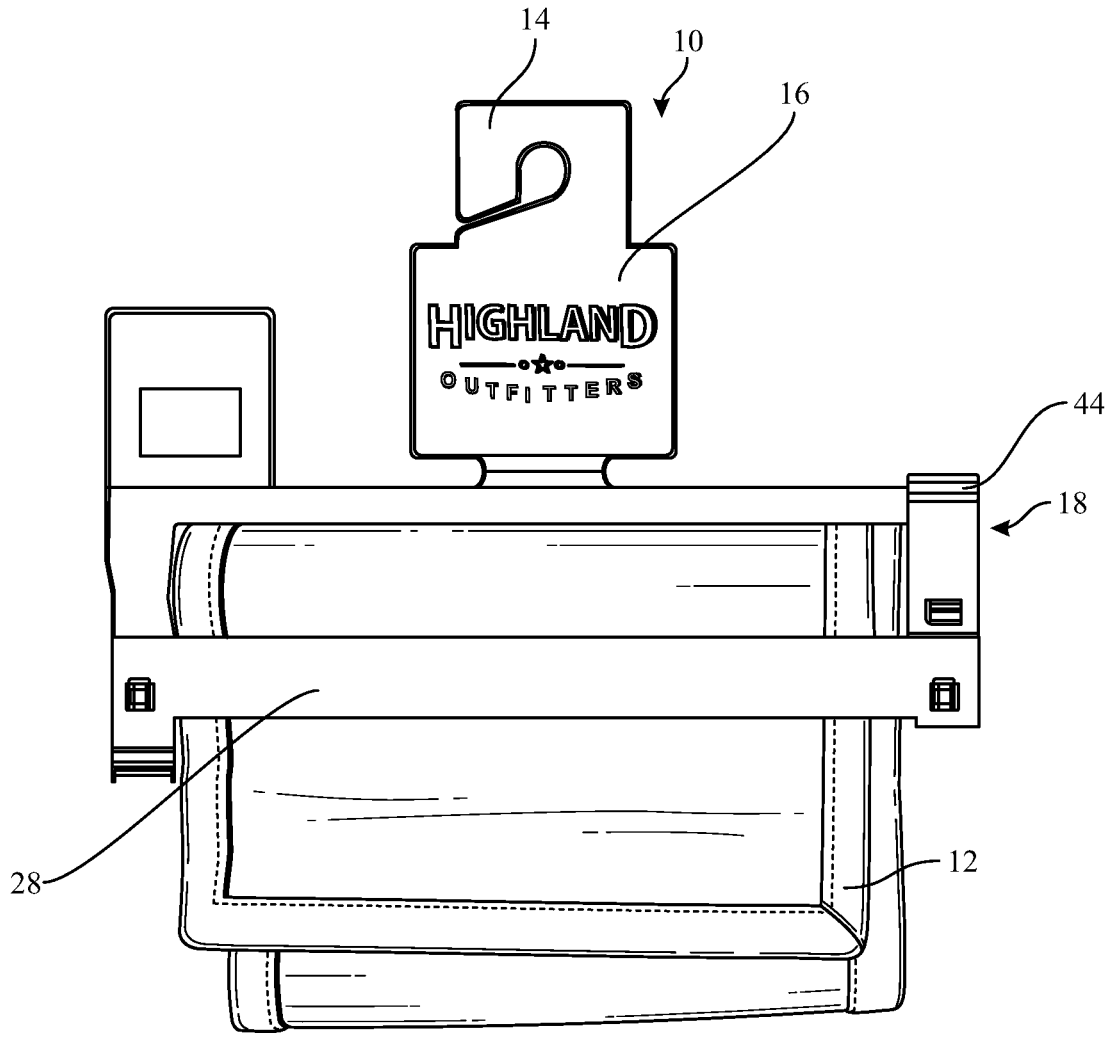
FIG. 1 is a front view of a wallet security display hanger, according to an embodiment of the present invention, with a wallet secured thereonto.

According to an embodiment of the present invention, referring to FIG. 1, there is shown a wallet security display hanger 10 designed and configured to support and secure a wallet 12, such as a trifold wallet. The wallet security display hanger 10 includes a display hanger hook 14, a logo display member 16, and a body member 18, with the display hanger hook 14 and the body member 18 connected and separated by the logo display member 16. The body member 18 of the wallet security display hanger 10 has flaps 28, 44, as a locking mechanism, that are repositionable between unlocked/open (FIGS. 2-4) and locked/closed (FIGS. 5-7) positions, as will be described in greater detail below.

Directional terms, such as left and right are referenced to an orientation in which the wallet security display hanger 10 is hung on a display hook with a logo surface of the logo display member 16 facing forward. However, the present invention is not thereby limited to use in any particular orientation.

Figure 2:
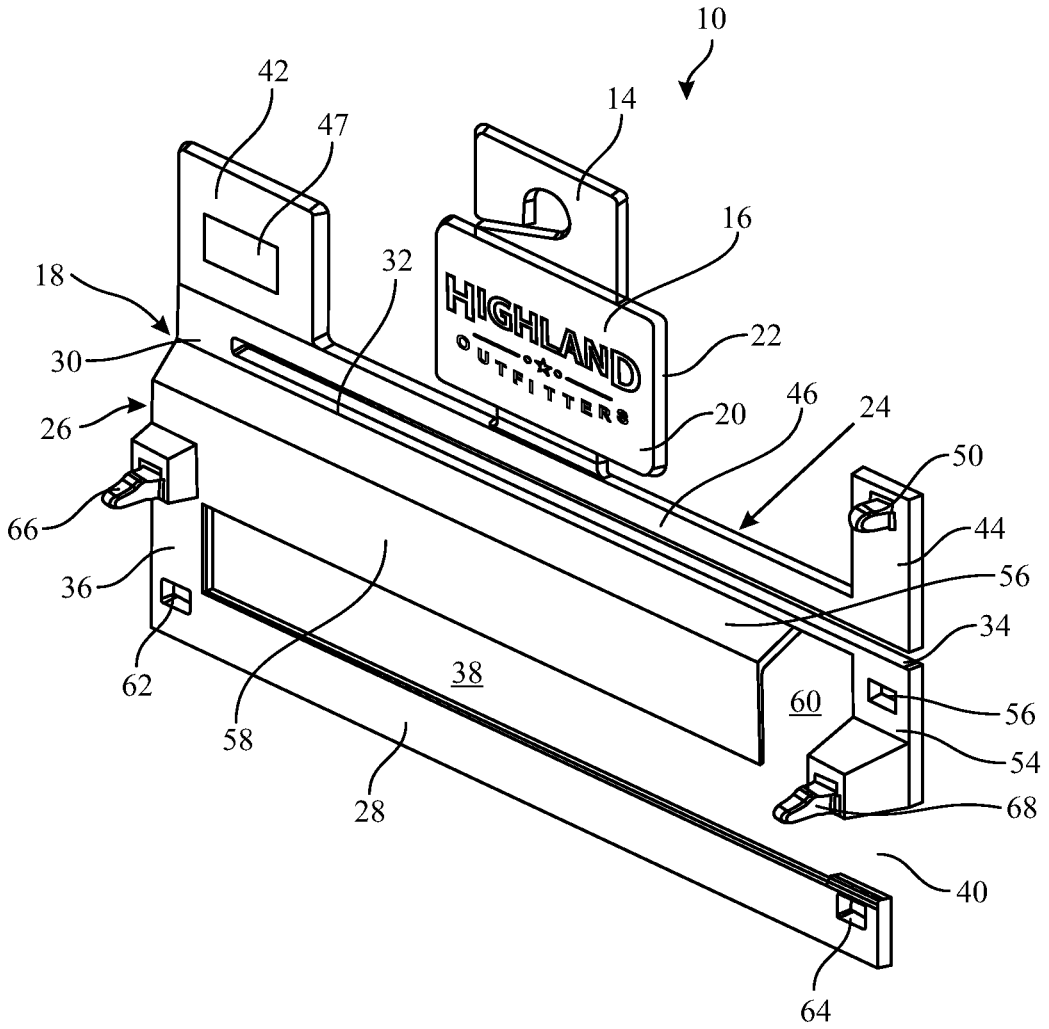
FIG. 2 is a perspective front view of the wallet security display hanger in FIG. 1 in an unlocked or open position.
Figure 3:
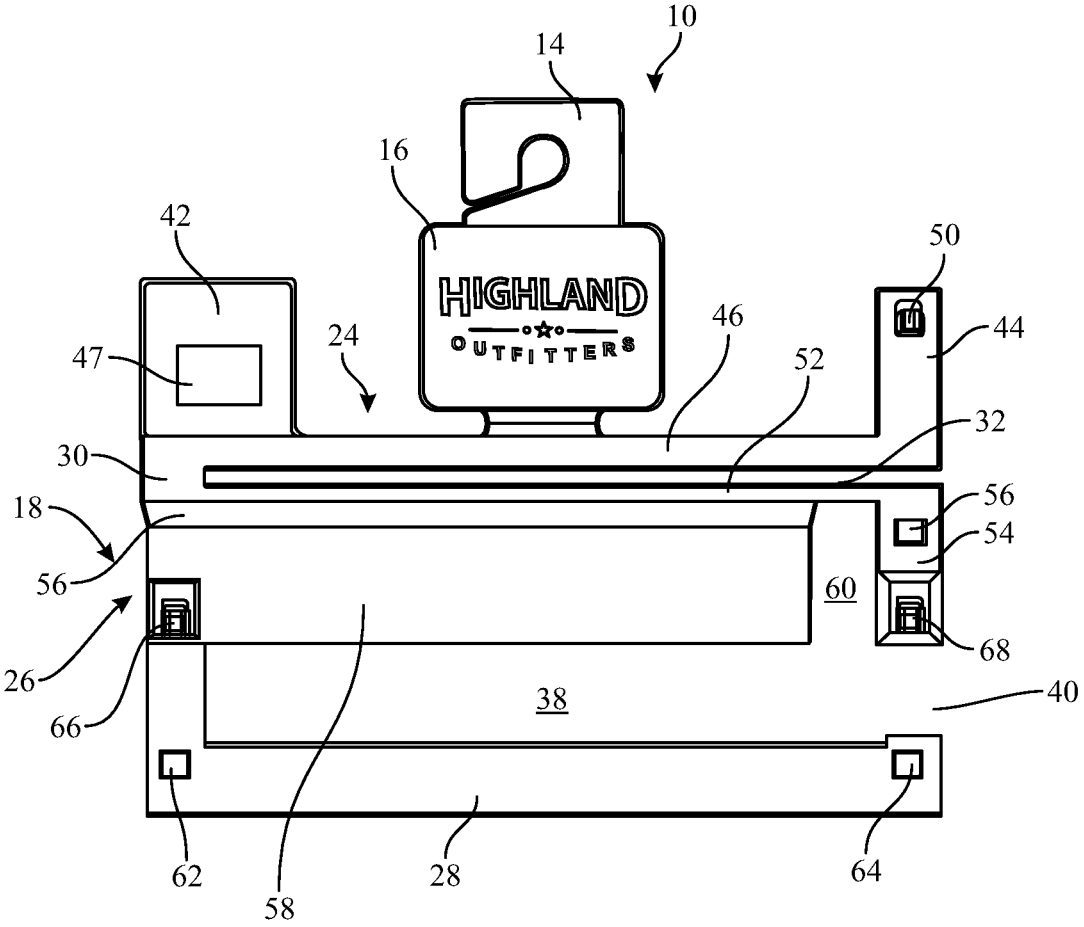
FIG. 3 is a front view of the wallet security display hanger in FIG. 2.
Figure 4:
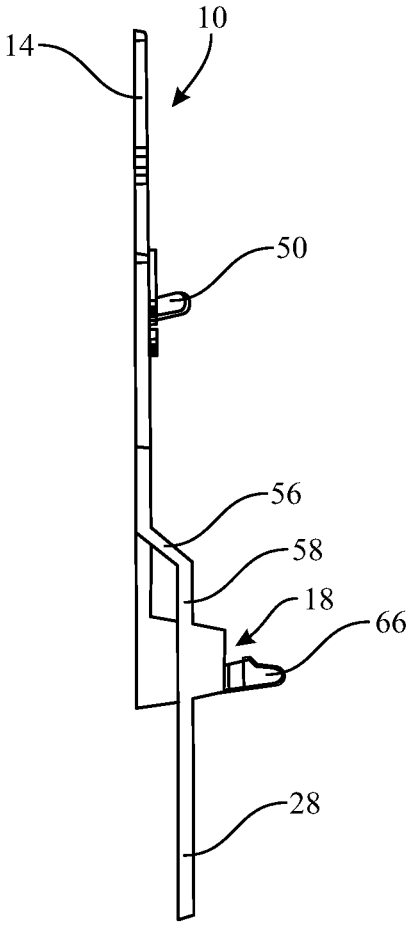
FIG. 4 is a side view of the wallet security display hanger in FIG. 2.

Referring to FIGS. 2-4, the display hanger hook 14 is positioned above the logo display member 16 and provides a mean for engaging with a display hook for retail display. The logo display member 16 provides front and rear surfaces 20, 22 for pictures such as logos or text (including product descriptions) to be printed on, embossed or otherwise attached.

The body member 18 has a one-piece structure and includes an upper support member 24, a lower support member 26, and a main flap 28. The upper and lower support members 24, 26 are integrally connected and separated by a connecting section 30, such that a first slot 32 is formed therebetween with a slot opening 34 on a right portion of the body member 18. The first slot 32 is designed and configured for easily engaging and inserting a portion of the wallet 12 therethrough to secure the wallet 12 to the wallet security display hanger 10. The lower support member 26 and the main flap 28 are integrally connected and separated by a main foldline section 36, such that a second slot 38 is formed therebetween with a slot opening 40 on the right portion of the body member 18.

The upper support member 24 includes a security tag member 42, an upper flap 44, and an upper support bar 46 integrally attached to and positioned below the logo display member 16. The security tag member 42 and the upper flap 44 are integrally connected to the upper support bar 46. Specifically, the security tag member 42 and the upper flap 44 extend vertically upward from left and right end portions of the upper support bar 46, respectively, such that they are both perpendicular to the upper support bar 46.

It is contemplated that a security tag 47, e.g., a radio frequency identification (RFID) tag or the like, may be applied to surfaces of the security tag member 42. The security tag 47 may be applied in any fashion and my even be concealed on the tag member 42. The security tag 47 attached to the wallet security display hanger 10 has a wide variety of uses, including tracking, inventory control, and security. The security tag 47 can also provide electronically readable information pertaining to the wallet 12. The security tag 47 is firmly secured onto the security tag member 42 such that it remains with the wallet 12 until after the time of purchase.

Figure 5:
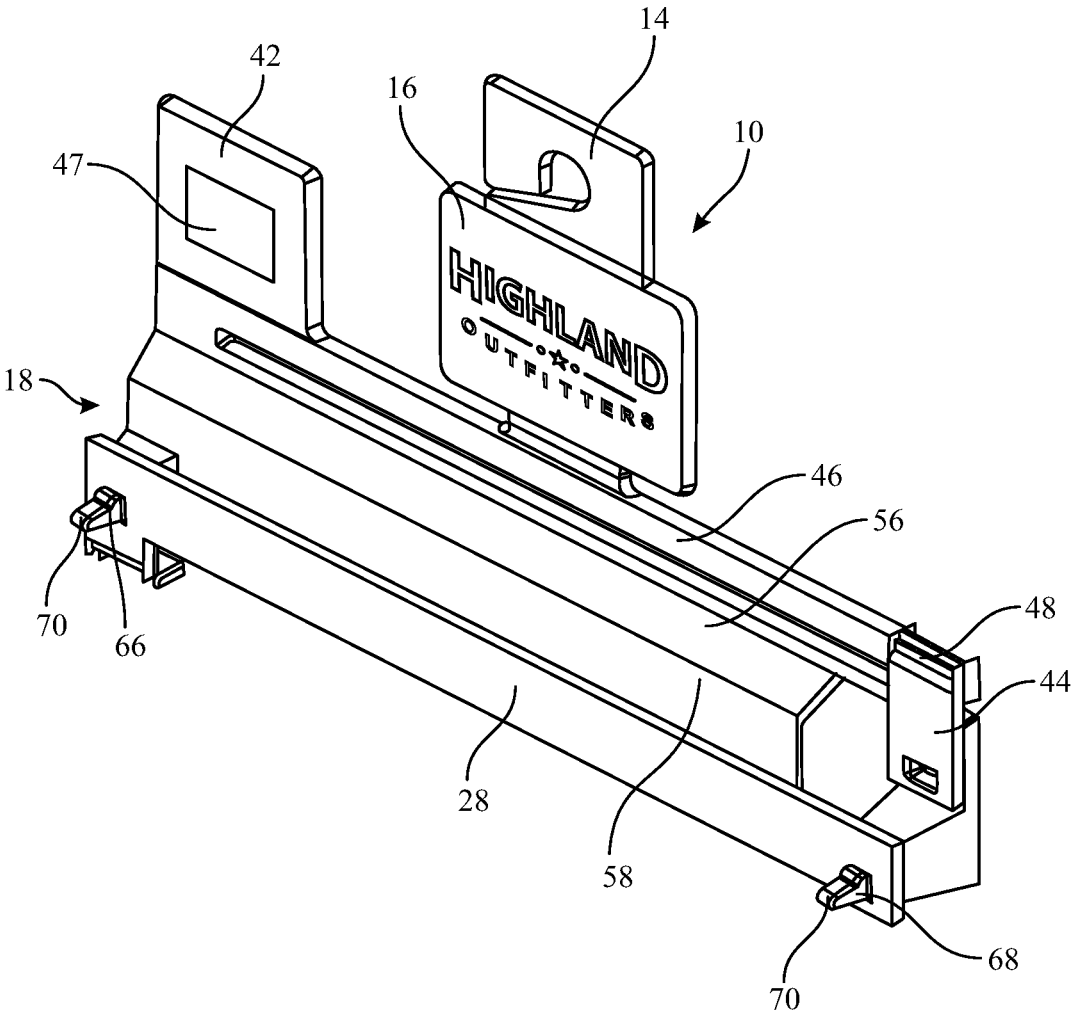
FIG. 5 is a perspective front view of the wallet security display hanger in FIG. 2 in a locked or closed position.

Referring to FIG. 5, the upper flap 44 includes a foldline portion 48 having a plurality of creases, at a lower portion thereof. The foldline portion 48 allows the upper flap 44 to be movable along the foldline portion 48 to overlie a part of the first slot 32 and folded onto the lower support member 26 to transition to the locked position. In addition, a first locking part 50 is formed integrally from an upper portion of the upper flap 44 and extends perpendicularly therefrom, as shown in FIGS. 2 and 3. The first locking part 50 is designed and configured to be engaged and inserted through corresponding locking aperture to provide a locking mechanism to prevent the wallet 12 from being removed from the wallet security display hanger 10, as will be described in greater detail below.

Referring again to FIGS. 2-4, the lower support member 26 includes a lower support bar 52 integrally connected to the connecting section 30, a receiving arm 54, an offset 56, and a support body 58. The receiving arm 54 is integrally attached to the lower support bar 52. Specifically, the receiving arm 54 extends vertically downward from a right end portion of the lower support bar 52 such that it is perpendicular thereto. A first locking aperture 56 is defined at an upper portion of the receiving arm 54, through which the first locking part 50 of the upper flap 44 could be inserted.

The lower support bar 52 and the support body 58 are integrally connected and separated by the offset 56 such that a stepped configuration is formed. When a fold of the wallet 12 is inserted through the first slot 32 of the wallet security display hanger 10, the stepped configuration holds the fold of the wallet 12 and allows the wallet 12 to be hung straight on a rack. As shown in FIG. 3, a length of the support body 58 is shorter than a length of the lower support bar 52 such that a gap 60 is created between the support body 58 and the receiving arm 54. A distance between the top of the offset 56 to the bottom of the support body 58 is equal to a height of the receiving arm 54.

Figure 6:
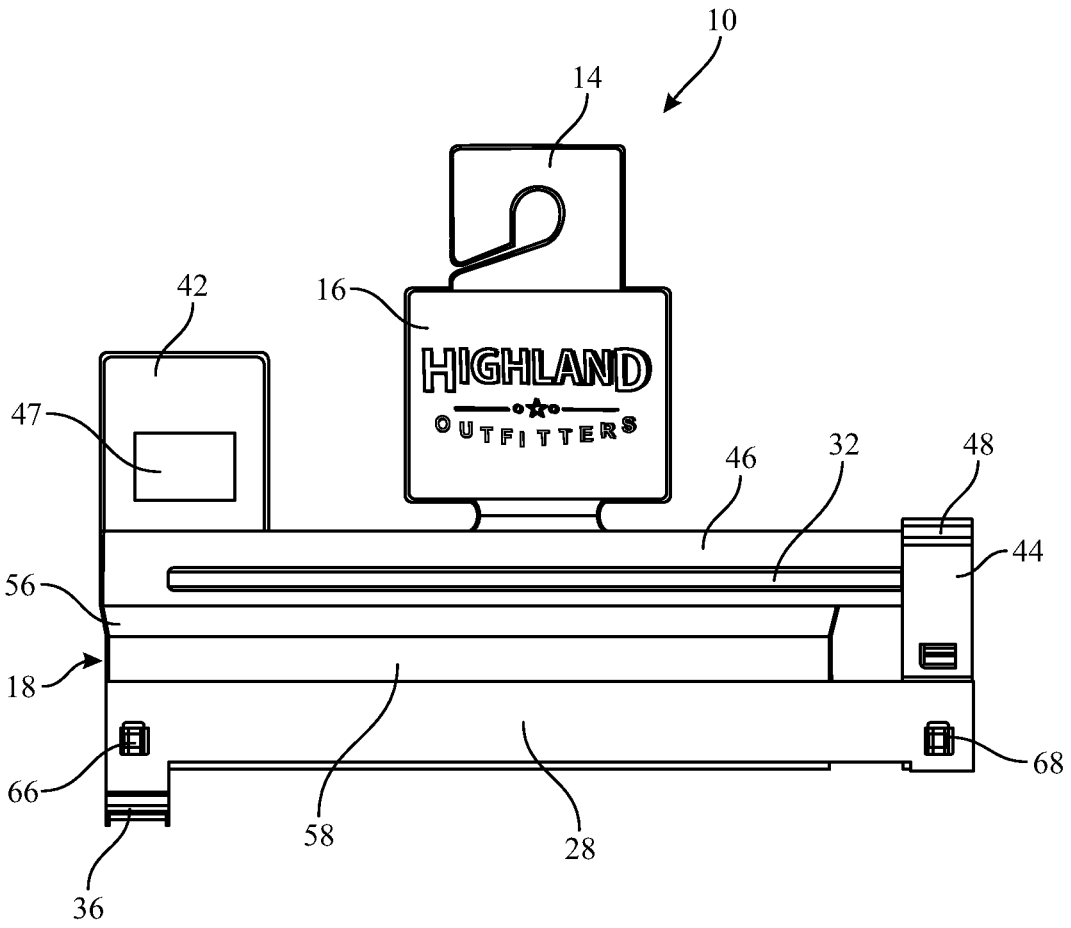
FIG. 6 is a front view of the wallet security display hanger in FIG. 5.

Referring to FIGS. 5 and 6, the main foldline section 36 has a plurality of creases to allow the main flap 28 to be movable along the main foldline section 36 and folded onto the lower support member 26 to transition to the locked position. The main flap 28 has second and third locking apertures 62, 64 that are defined at left and right end portions of the main flap 28, respectively, as shown in FIGS. 2 and 3. When the main flap 28 transitions to the locked/closed position, the second and third locking apertures 62, 64 engage with a second locking part 66 formed integrally from a lower left corner of the support body 58 of the lower support member 26 and a third locking part 68 formed integrally from a lower portion of the receiving arm 54, respectively.

Figure 7:
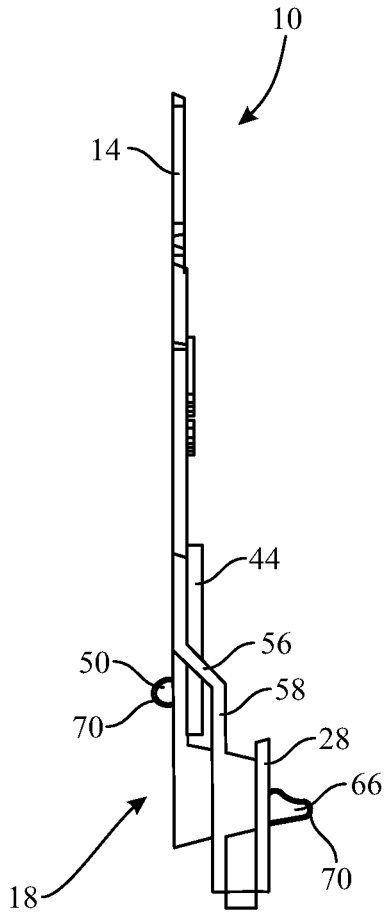
FIG. 7 is a side view of the wallet security display hanger in FIG. 5.

Contours of the first, second, and third locking apertures 56, 62, 64 and the first, second, and third locking parts 50, 60, 68 are configured such that, when engaged, they collectively provide a locking mechanism with each tip 70 of the first, second, and third locking parts 50, 60, 68 protruding outwardly from each of the first, second, and third locking apertures 56, 62, 64, as illustrated in FIGS. 5-7. Once the wallet security display hanger 10 is in the locked/closed position, it is extremely difficult to open it with bare hands to separate the wallet 12 from the wallet security display hanger 10. In fact, the locked wallet security display hanger 10 is not readily openable without destruction of the display hanger 10.

The wallet security display hanger 10 is made out of one or more materials having suitable properties for a desired application, including strength, weight, rigidity, etc. Plastic is generally preferred. It will be appreciated that other designs and configurations could be used for the wallet security display hanger 10, as deemed suitable for a given application factors.

In use of the wallet security display hanger 10, first, in the unlocked/open position, one of the folds of the wallet 12 is inserted into the first slot 32 such that the wallet 12 is supported by the lower support member 26. Then, by folding the upper and main flaps 44, 28 along the foldlines and closing and locking the upper and main flaps 44, 28, the wallet security display hanger 10 is ready for suspension on a display hook or the like, such as a pegboard hook, for retail display. Once a consumer purchases the wallet 12, the consumer can remove it from the wallet security display hanger 10 by cutting along the foldlines with scissors to allow the upper and main flaps 44, 28 to be open. Alternatively, the wallet 12 can be removed from the wallet security display hanger 10 by cutting or clipping each tip 70 of the first, second, and third locking parts 50, 60, 68.

From the foregoing, it will be appreciated that a wallet security display hanger according to the present invention is used to securely display wallets and deter theft, while providing a cost efficient design for retail display.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A wallet security display hanger comprising:

a display hanger hook; and a body member integrally connected to the display hanger hook, the body member including:

an upper support member having an upper flap;

a lower support member integrally connected to the upper support member via a connecting section, such that a first slot is formed between the upper and lower support members; and a main flap integrally connected to the lower support member via a main foldline section having a plurality of creases, such that a second slot is formed between the lower support member and the main flap, wherein the upper and main flaps are configured to be folded onto the lower support member to close the first and second slots for locking engagement, respectively, to prevent the wallet from being removed from the wallet security display hanger.

2. The wallet security display hanger of claim 1, wherein the upper support member further includes an upper support bar integrally attached to the logo display member, and a security tag member.

3. The wallet security display hanger of claim 2, wherein the security tag member and the upper flap are integrally connected to left and right end portions of the upper support bar, respectively, and extend vertically upward therefrom.

4. The wallet security display hanger of claim 1, wherein the upper flap includes a foldline portion, having a plurality of creases, at a lower portion thereof to allow the upper flap to be movable along the fold line portion to overlie a part of the first slot.

5. The wallet security display hanger of claim 1, wherein a first locking part is formed integrally from an upper portion of the upper flap and extends perpendicularly therefrom.

6. The wallet security display hanger of claim 5, wherein the lower support member includes a lower support bar integrally connected to the connecting section, a receiving arm integrally connected to the lower support bar, an offset, and a support body.

7. The wallet security display hanger of claim 6, wherein the receiving arm extends vertically downward from a right end portion of the lower support bar such that it is perpendicular thereto.

8. The wallet security display hanger of claim 6, wherein a first locking aperture is defined at an upper portion of the receiving arm, through which the first locking part of the upper flap could be inserted.

9. The wallet security display hanger of claim 6, wherein the lower support bar and the support body are integrally connected and separated by the offset such that a stepped configuration is formed.

10. The wallet security display hanger of claim 9, wherein, when a fold of the wallet is inserted through the first slot, the stepped configuration holds the fold of the wallet and allows the wallet to be hung straight on a rack.

11. The wallet security display hanger of claim 6, wherein a length of the support body is shorter than a length of the lower support bar such that a gap is created between the support body and the receiving arm.

12. The wallet security display hanger of claim 1, wherein the main foldline section allows the main flap to be movable along the main foldline section.

13. The wallet security display hanger of claim 6, wherein the main flap has second and third locking apertures that are defined at left and right end portions of the main flap, respectively.

14. The wallet security display hanger of claim 13, wherein second and third locking parts are formed integrally from a lower left corner of the support body of the lower support member and a lower portion of the receiving arm, respectively.

15. The wallet security display hanger of claim 14, wherein, when the main flap transitions to a locked position, the second and third locking apertures engage with the second and third locking parts, respectively.

16. The wallet security display hanger of claim 15, wherein contours of the first, second, and third locking apertures and the first, second, and third locking parts are configured such that, when engaged, they collectively provide a locking mechanism, with each tip of the first, second, and third locking parts protruding outwardly from each of the first, second, and third locking apertures.

17. The wallet security display hanger of claim 1, wherein the display hanger hook provides a mean for engaging with a display hook for retail display.

18. The wallet security display hanger of claim 1, wherein the wallet security display hanger further includes a logo display member that is positioned between the display hanger hook and the body member.

19. The wallet security display hanger of claim 2, a security tag is attached to the security tag member for tracking, inventory control, and security.

20. The wallet security display hanger of claim 19, wherein the security tag is a radio frequency identification (RFID) tag.

* * * * *